US010364590B1

(12) United States Patent
Johnston

(10) Patent No.: US 10,364,590 B1
(45) Date of Patent: Jul. 30, 2019

(54) FENCE POST PULLER AND PULLER-DRIVER COMBINATION

(71) Applicant: Gregory L. Johnston, St. Clair, MO (US)

(72) Inventor: Gregory L. Johnston, St. Clair, MO (US)

( * ) Notice: Subject to any disclaimer, the term of this patent is extended or adjusted under 35 U.S.C. 154(b) by 515 days.

(21) Appl. No.: 15/293,344

(22) Filed: Oct. 14, 2016

(51) Int. Cl.
*E04H 17/26* (2006.01)
*B25D 1/16* (2006.01)
*E02D 7/04* (2006.01)

(52) U.S. Cl.
CPC ..... *E04H 17/263* (2013.01); *B25D 1/16* (2013.01); *E02D 7/04* (2013.01); *E04H 17/265* (2013.01)

(58) Field of Classification Search
CPC ..... E04H 17/263; E04H 17/265
USPC ..... 173/90, 91, 131; 175/19
See application file for complete search history.

(56) References Cited

U.S. PATENT DOCUMENTS 1,916,463 A * 7/1933 Carrel ..... E04H 17/261 254/132
1,919,463 A 7/1933 Carrel
2,690,555 A * 9/1954 Baynard ..... G01S 13/931 342/71
3,747,690 A 7/1973 Deike
4,040,601 A * 8/1977 Boardman ..... B66F 19/00 254/133 R
5,042,591 A * 8/1991 Hull ..... B25D 1/16 173/132
5,261,642 A * 11/1993 Stambaugh ..... E04H 17/265 254/30
5,499,795 A * 3/1996 Mathews ..... E04H 17/265 254/30
5,542,479 A 8/1996 Stachler et al.
6,364,031 B1 4/2002 Amicangelo
7,111,690 B2 * 9/2006 Kleinert ..... E02D 7/04 173/128
8,701,791 B2 * 4/2014 Page ..... E02D 9/02 173/1
8,955,612 B2 2/2015 O'Toole
2007/0181320 A1 * 8/2007 Mason ..... B25D 1/16 173/90
2012/0145425 A1 * 6/2012 Page ..... E02D 9/02 173/90
2016/0290004 A1 * 10/2016 Kennemer ..... B25B 13/50

* cited by examiner

*Primary Examiner* — Andrew M Tecco
*Assistant Examiner* — Eyamindae C Jallow
(74) *Attorney, Agent, or Firm* — Grace J. Fishel

(57) ABSTRACT

A T-post puller with a channel providing a sliding fit over a T-post. The T-post puller when rotated relative to the T-post causes protrusions in the channel to engage the bottom of a T-post stud while a retractable member holds the T-post puller in stud engaging position. The T-post puller may be integrated with a T-post driver in a fencing tool including a drive tube for use in driving posts into the ground and for use as a slide hammer for extracting them from the ground.

15 Claims, 4 Drawing Sheets

FENCE POST PULLER AND PULLER-DRIVER COMBINATION

BACKGROUND OF THE INVENTION

Field of the Invention

The present invention relates to a puller for use in exerting an upwards driving force on multi-sized steel fence posts of the type having a T-cross section. The puller may be coupled with a driver for exerting a downwards driving force on the post. The puller-driver combination facilitates the insertion and extraction of T-posts from the ground.

Brief Description of the Prior Art

T-posts are held by hand and may be driven into the ground using simple devices such as a sledge hammer. There are also slide hammers which hold the post in an interior cavity while driving the T-post into the ground. Driving the posts is relatively easy, pulling them out is a problem. Heavy equipment such as a backhoe and jacking devices are required as simply grasping the post and manually trying to pull it upwards can be extremely difficult if not impossible when the ground is dry and compacted.

The use of temporary fencing is increasingly common as cross fencing has been removed in many rural areas. For use in pasturing unfenced fields, such as corn stalks, temporary fencing may be installed around the perimeter of the field which is then removed before the next planting season. Temporary fencing is also used in pastures for flash pasturing for better use of the forage. These fences need to be removed and reinstalled for use in subdividing the pasture. T-posts are also used in construction fences, snow fences and the like. For all of these purposes there is a need for a fence post puller that is easy to use and that can be hand carried and hand operated.

BRIEF SUMMARY OF THE INVENTION

In view of the above, it is an object of the present invention to provide a hand-held puller to extract a fence post from the ground or similar substrate. It is another object of the invention to provide a puller-driver combination that can be provided or assembled as one piece for use in driving and extracting fence posts. It is a further object to provide a fencing tool including a puller-driver combination and a driving tube.

The subject puller, puller-driver combination and fencing tool are for use with a range of commercially available T-posts having a T-cross section including a stem and a pair of wings with a plurality of spaced apart studs along a head of the stem. An embodiment of the puller includes a body with a geometric channel configured such that the T-post puller may be slipped over an end of a T-post to be pulled. The channel has first and second spaced apart stud engaging protrusions configured that in stud engaging position, a wing of the T-post is wedged against a shoulder of one of the protrusions while the other of the protrusions is positioned below a stud, preferably not the top stud on the post. A retractable member is provided in the body for engaging the stem of the T-post when the puller is in stud engaging position. The puller described above may be combined with a driver and a hollow spacer either as separate elements or integrated into a one-piece construction. The driver includes a cap with a closed end and internal screw threads for threaded engagement with a drive tube. The puller-driver combination with the hollow drive tube forms a fencing tool which may be used to drive T-posts into the ground and to pull them out with the drive tube acting as slide hammer on the T-post puller.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
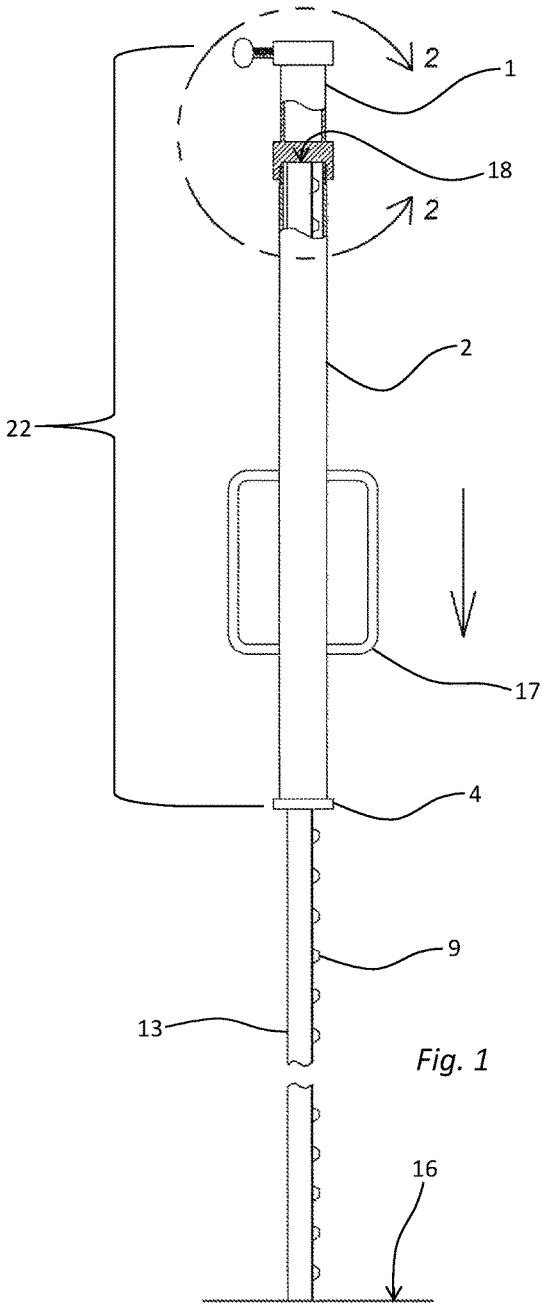
FIG. 1 is a side view of a T-post puller-driver combination in accordance with the present invention shown in a configuration used to drive a T-post into the ground and with the puller-driver combination and the top of a hollow drive tube shown in partial cross sectional views.
Figure 2:
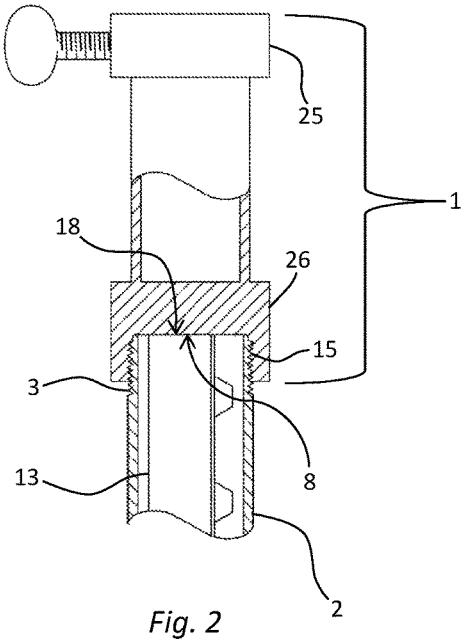
FIG. 2 is an enlarged detail view as defined by region 2-2 in FIG. 1 showing a partial sectional cut-away view of the puller-driver combination and the threaded end of the hollow drive tube and T-post in the configuration used to drive a T-post into the ground.
Figure 7A:
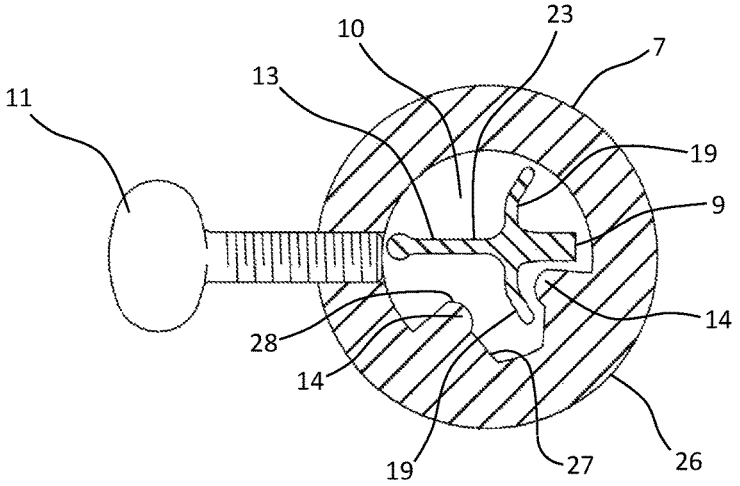
FIG. 7A is a cross-sectional view taken along plane 5-5 of the puller in FIG. 4 showing the puller in the T-post clearance position and the set screw in the retracted position.
Figure 7B:
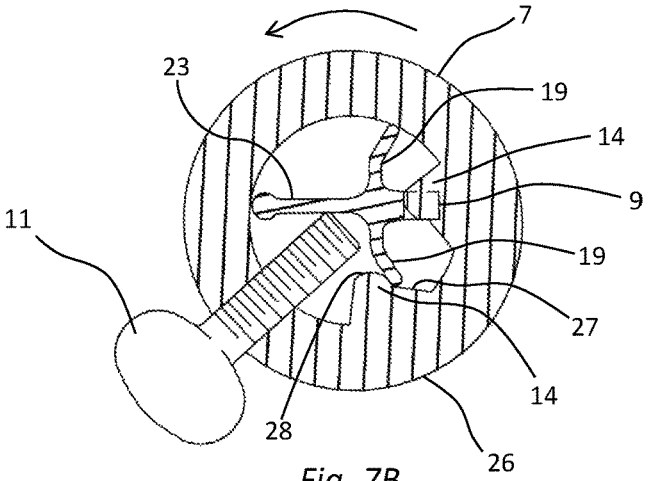
FIG. 7B is a cross-sectional view taken along plane 5-5 of the puller in FIG. 4 showing the puller rotated counter-clockwise relative to the T-post wherein the T-post stud engagement protrusion is positioned under a T-post stud and the set screw is in its inward rotational locking position.

Referring to the drawings more particularly by reference character and beginning with FIGS. 1 and 2, reference numeral 22 refers to a fencing tool including a T-post puller-driver combination 1 and hollow drive tube 2 for use in setting and extracting a T-post 13. T-post 13 has a T-cross section as shown in FIGS. 7A, 7B and 8 including a stem 23 and a pair of wings 19 with a plurality of spaced apart studs 9 along its length on a head of the stem.

Figure 5:
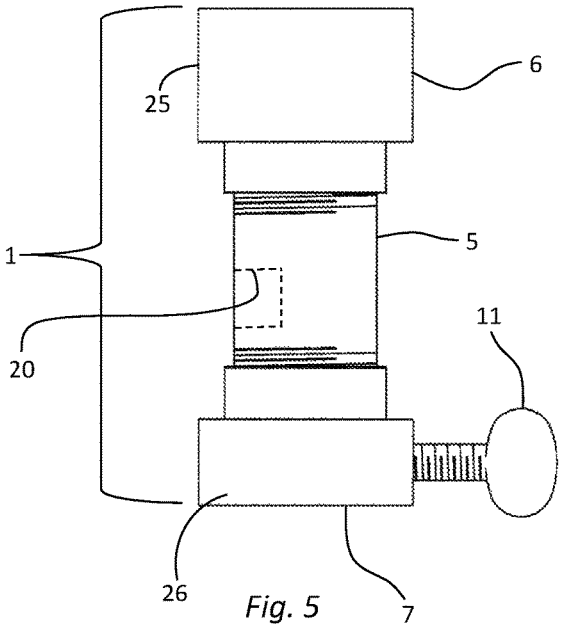
FIG. 5 is a side view of the puller-driver combination.

With continuing reference to FIG. 1, puller-driver combination 1 includes a puller 7 and a driver 6 assembled on a spacer 5 as best seen in FIG. 5. Hollow drive tube 2 has a threaded first end 3 and an enlarged second end 4. Handles 17 may be provided along opposite side edges for use in driving the tube up and down as will become apparent. Driver 6 comprises a hollow threaded cap 25, a closed end 8 of which provides a T-post driving surface. FIG. 2 is an enlarged sectional view taken along line 2-2 in FIG. 1 showing internal screw threads 15 on cap 25 used to attach puller-driver combination 1 to threaded first end 3 of hollow drive tube 2. Using handles 17 hollow drive tube 2 may be raised and lowered, causing closed end 8 of driver 6 to repeatedly impact a top surface 18 of T-post 13 until the post is driven into the ground 16 to the desired depth.

Figure 3:
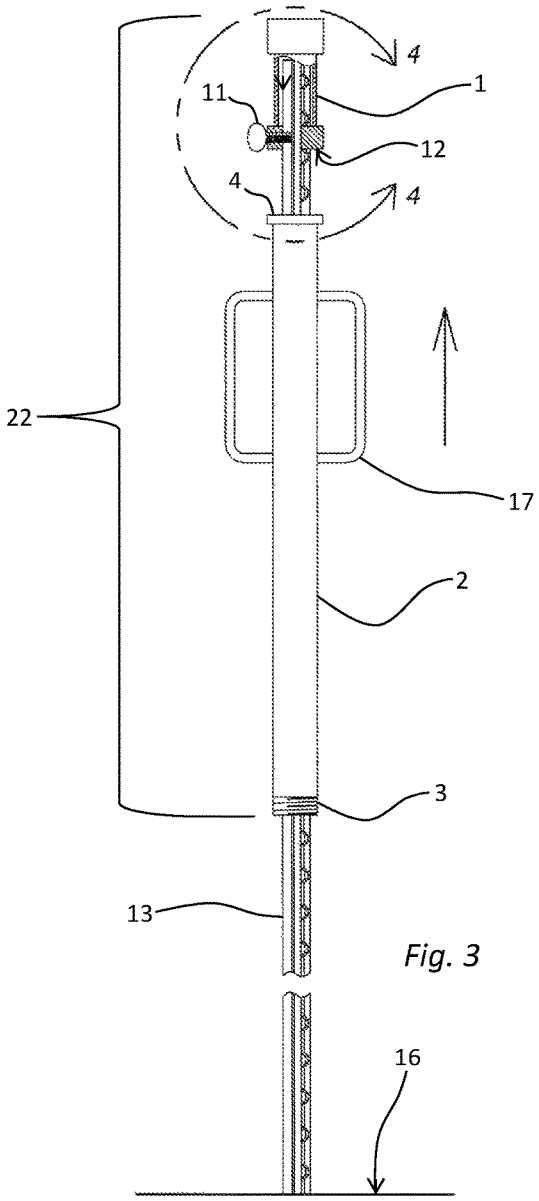
FIG. 3 is a side view of the T-post puller-driver combination in accordance with the present invention shown in a configuration used to extract a T-post from the ground and with the puller-driver combination shown in partial cross sectional views and the drive tube acting as a slide hammer.
Figure 4:
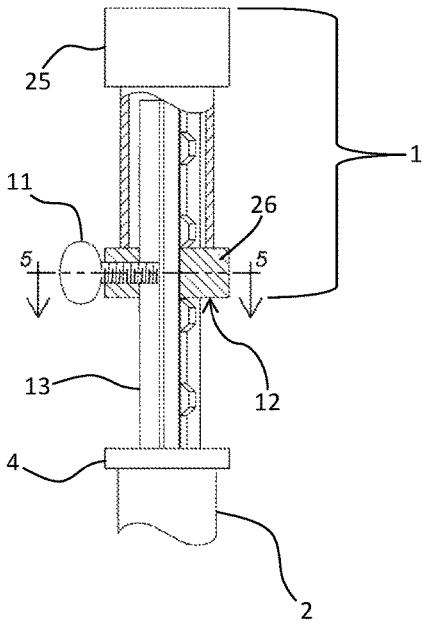
FIG. 4 is an enlarged detail view as defined by region 4-4 in FIG. 3 showing a partial sectional view the puller-driver combination and a set screw. Also shown is a partial view of the enlarged end of the hollow drive tube and a T-post in the configuration used to extract a T-post into the ground.
Figure 6:
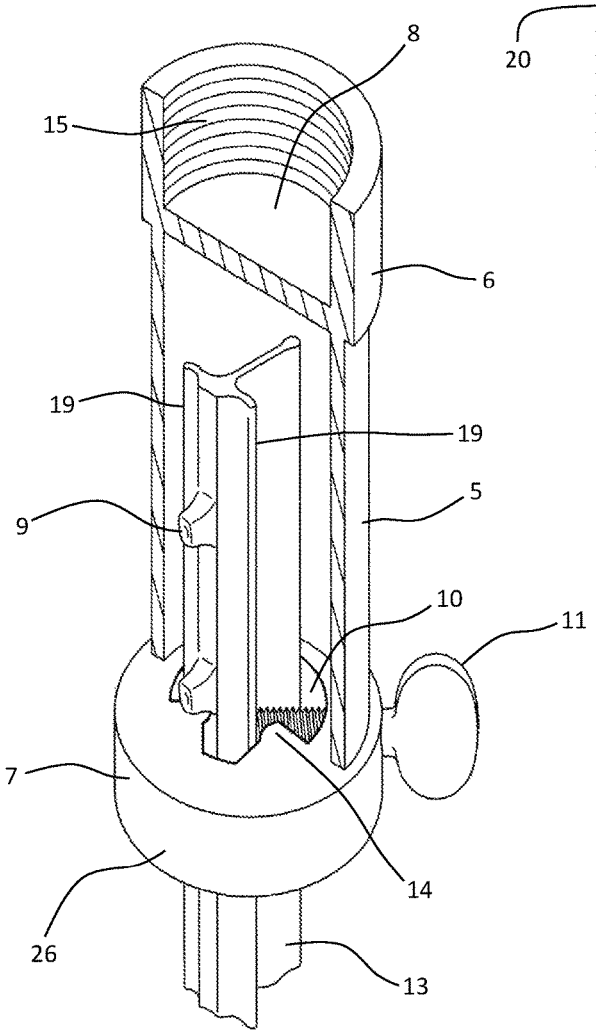
FIG. 6 is a partial cross-sectional perspective view of the puller-driver combination showing the puller rotated counter-clockwise relative to the T-post wherein a T-post stud engagement protrusion is positioned under a T-post stud and the set screw is in its inward rotational locking position.

Now referring to FIGS. 3 and 4, puller-driver combination 1 is shown unthreaded from hollow drive tube 2 and hollow drive tube 2 slipped over the top of T-post 13 with enlarged end 4 shown upwardly directed. As best seen in FIG. 6 puller 7 is attached to upper end of T-post 13. Puller 7 includes a body 26 with a geometric channel 10 having a cavity configured such the puller 7 may be slipped over a top end of T-post 13. Channel 10 has first and second spaced apart stud engaging protrusions 14. The stud engaging protrusions 14 are configured such that when puller 7 is rotated on T-post 13 from a position as shown in FIG. 7A into a stud engaging position as shown in FIGS. 6 and 7B, one of wings 19 of T-post 13 is wedged against a shoulder 27 of one of stud engaging protrusions 14 while an upper stud 9 of T-post 13 is positioned above the other of stud engaging protrusions 14. As shown, shoulder 27 may be sloped with a lobe 28 at its inner end to serve as a stop for T-post wing 19. Puller further includes a retractable member 11 such as set screw for engaging stem 23 of T-post 13 in stud engaging position. In use, hollow drive tube 2 may be slid up and down as a slide hammer, impacting a lower side 12 of body 26 with enlarged end 4 acting as a ram. The force applied to body 26 is transferred to stud 9 and causes T-post 13 to be driven out of the ground 16. A window 20 may be provided in a sidewall of spacer 5 to assist a user in the alignment of puller 7 with T-post 13 although this may be easily accomplished without a window by aligning retractable member 11 with stem 23 and then rotating the puller counterclockwise as shown in FIG. 7B. It should be noted here that while various geometrical elements have been depicted for channel 10 there can be alternate geometries that could achieve the same sliding clearance, rotational stopping and stud engagement means as depicted without deviating from the intent of the invention.

Figure 8:
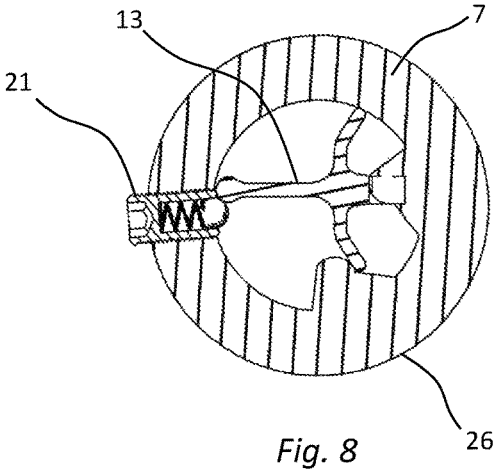
FIG. 8 is a cross-sectional view taken along plane 5-5 of the puller in FIG. 4 of an alternate embodiment showing the puller rotated counter-clockwise relative to the T-post wherein the T-post stud engagement protrusion is positioned under a T-post stud and a spring loaded detent is used to hold the puller in its rotationally locking position.

FIG. 8 is a cross-sectional view taken along plane 5-5 of puller 7 in FIG. 4 of an alternate embodiment showing the puller rotated counter-clockwise with stud engaging protrusion 14 positioned under stud 9 and instead of a set screw 11 a spring loaded detent 21 is used to hold the puller 7 in its stud engaging position.

While puller 7 is illustrated in assembly with driver 6 on spacer 5 either threaded thereon or integral therewith, puller 7 has utility standing alone. The assembly, however, has the advantage that the tool including both driver and puller may be easily hand carried by one of handles 17 with driver 6 threaded on drive tube 2. In addition, the combined weight of puller-driver combination 1 assists driver 6 in driving T-post 13 into the ground 16.

The distance the top stud 9 is from the top of the T-post varies from post to post as they are extruded and then cut to length. For that reason, spacer 5 is hollow and has a length such that puller 7 may be slipped over a distance that in stud engaging position the stud 9 engaged by puller 7 is not at the very top of the post. A representative puller-driver combination 1 has spacer 5 formed of a carbon steel pipe with a length of 4 inches and an internal diameter of 1½ inches. In the representative but non-limiting example, body 26 of puller 7 is 3 inches in diameter and 1 inch in thickness which generally corresponds to the spacing between studs 9 and like driver 6 is formed hardened steel. A representative drive tube 2 is formed of a 24 inch long piece of carbon steel pipe having an ID of 2.0 inches that is threaded on one end to match the threads of cap 25 with a steel disk welded at the opposite end for use as enlarged end 4.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A T-post puller for a T-post having a T-cross section including a stem and a pair of wings with a plurality of spaced apart studs along a head of the stem, said T-post puller comprising a body with a geometric channel configured such that the T-post puller may be slipped over an end of a T-post, said channel having first and second spaced apart stud engaging protrusions, said stud engaging protrusions configured such that when the body is rotated into stud engaging position one of said pair of wings is wedged against a shoulder of a first of the stud engaging protrusions while the second stud engaging protrusion is positioned below a stud, said T-post puller further having a retractable member engaging the stem of the T-post in stud engaging position.

2. The T-post puller of claim 1 wherein the retractable member is a set screw or a spring loaded detent.

3. The T-post puller of claim 1 wherein the first and second stud engaging protrusions have opposing sloped shoulders.

4. The T-post puller of claim 3 wherein the first and second stud engaging protrusions have a lobe on an inner end of the sloped shoulder serving as a stop.

5. The T-post puller of claim 1 formed of hardened steel and having a diameter of about 3 inches and a thickness of about 1 inch corresponding to a distance between the studs.

6. A T-post puller-driver combination for a T-post having a T-cross section including a stem and a pair of wings with a plurality of spaced apart studs along a head of the stem, comprising a T-post puller, a T-post driver and a hollow spacer, said T-post puller comprising a body with a geometric channel configured such that the T-post puller may be slipped over an end of a T-post, said channel having first and second spaced apart stud engaging protrusions, said stud engaging protrusions configured such that when the body is rotated into stud engaging position one of said pair of wings is wedged against a shoulder of a first of the stud engaging protrusions while the second stud engaging protrusion is positioned below a stud, said T-post puller further having a retractable member engaging the stem of the T-post in stud engaging position, said T-post driver comprising a cap with a closed end and internal screw threads, said hollow spacer spacing the T-post puller and T-post driver apart a distance sufficient that the T-post puller can be slid over the T-post a distance that the T-post puller engages a next to top stud in stud engaging position.

7. The combination of claim 6 wherein the T-post puller and T-post driver are formed of hardened steel.

8. The combination of claim 6 wherein the first and second stud engaging protrusions of the T-post puller have opposing sloped shoulders.

9. The combination of claim 8 wherein the first and second stud engaging protrusions have a lobe on an inner end of the sloped shoulder serving as a stop.

10. A fencing tool comprising a T-post puller-driver combination and a hollow drive tube for a T-post having a T-cross section including a stem and a pair of wings with a plurality of spaced apart studs along a head of the stem, said puller-driver combination comprising a T-post puller, a T-post driver and a hollow spacer, said T-post puller comprising a body with a geometric channel configured such that the T-post puller may be slipped over an end of a T-post, said channel having first and second spaced apart stud engaging protrusions, said stud engaging protrusions configured such that when the body is rotated into stud engaging position one of said pair of wings is wedged against a shoulder of a first of the stud engaging protrusions while the second stud engaging protrusion is positioned below a stud, said T-post puller further having a retractable member engaging the stem of the T-post in stud engaging position; said T-post driver comprising a cap with a closed end and internal screw threads; and, said hollow spacer spacing the T-post puller and T-post driver apart a distance sufficient that the T-post puller can be slid over the T-post a distance that the T-post puller engages a next to top stud in stud engaging position, said hollow drive tube having a first end cooperatively threaded for attachment of the puller-driver combination for use in driving T-posts into the ground and said drive tube having a second enlarged end for use as a ram against the T-post puller for extracting the T-post from the ground when the T-post puller is in stud engaging protrusion.

11. The fencing tool of claim 10 wherein the hollow drive tube has a pair of handles provided on opposite sides of the tube.

12. The fencing tool of claim 10 wherein the T-post puller and T-post driver are formed of hardened steel.

13. The fencing tool of claim 10 wherein the first and second stud engaging protrusions of the T-post puller have opposing sloped shoulders.

14. The fencing tool of claim 13 wherein the first and second stud engaging protrusions have a lobe on an inner end of the sloped shoulder serving as a stop.

15. The fencing tool of claim 10 wherein the drive tube is formed of a carbon steel pipe that is threaded at one end to match the threads of the cap and has a disk welded at the opposite end forming the enlarged end.

* * * * *